US007467654B2

(12) United States Patent
Urick

(10) Patent No.: US 7,467,654 B2
(45) Date of Patent: Dec. 23, 2008

(54) DEVICE FOR MAINTAINING WINDOW COVERINGS OR VERTICALLY HANGING FLEXIBLE PANELS

(75) Inventor: Mark Allen Urick, Williamsburg, VA (US)

(73) Assignee: Stayfold, Inc., Williamsburg, VA (US)

( * ) Notice: Subject to any disclaimer, the term of this patent is extended or adjusted under 35 U.S.C. 154(b) by 429 days.

(21) Appl. No.: 11/159,947

(22) Filed: Aug. 2, 2005

(65) Prior Publication Data

US 2006/0185802 A1 Aug. 24, 2006

(51) Int. Cl.
*A47H 13/14* (2006.01)

(52) U.S. Cl. ..... 160/348; 160/349.2

(58) Field of Classification Search ..... 160/348, 160/349.1, 349.2, 330
See application file for complete search history.

(56) References Cited

U.S. PATENT DOCUMENTS 2,435,183 A * 1/1948 Pezzella ..... 160/348
3,090,533 A * 5/1963 Claeys et al. ..... 223/35
3,119,444 A * 1/1964 Polkosnik ..... 160/348
3,185,207 A * 5/1965 Humble ..... 160/382
3,654,983 A * 4/1972 Hachtel ..... 160/348
4,073,331 A * 2/1978 Zilver ..... 160/348
D292,370 S * 10/1987 Fairbanks ..... D8/369
6,591,432 B1 7/2003 Feinstein

* cited by examiner

*Primary Examiner*—Blair M. Johnson
(74) *Attorney, Agent, or Firm*—Williams Mullen; M. Bruce Harper

(57) ABSTRACT

The device for maintaining window coverings or vertically hanging flexible panels includes a frame, apparatus for retaining the flexible panel in the frame and an attachment to attach the flexible panel to the frame. Preferably, the device is lightweight and nonporous. The device is formed into a desired shape in order to maintain a desired orientation of the hanging flexible panel.

10 Claims, 9 Drawing Sheets

Fig. 3
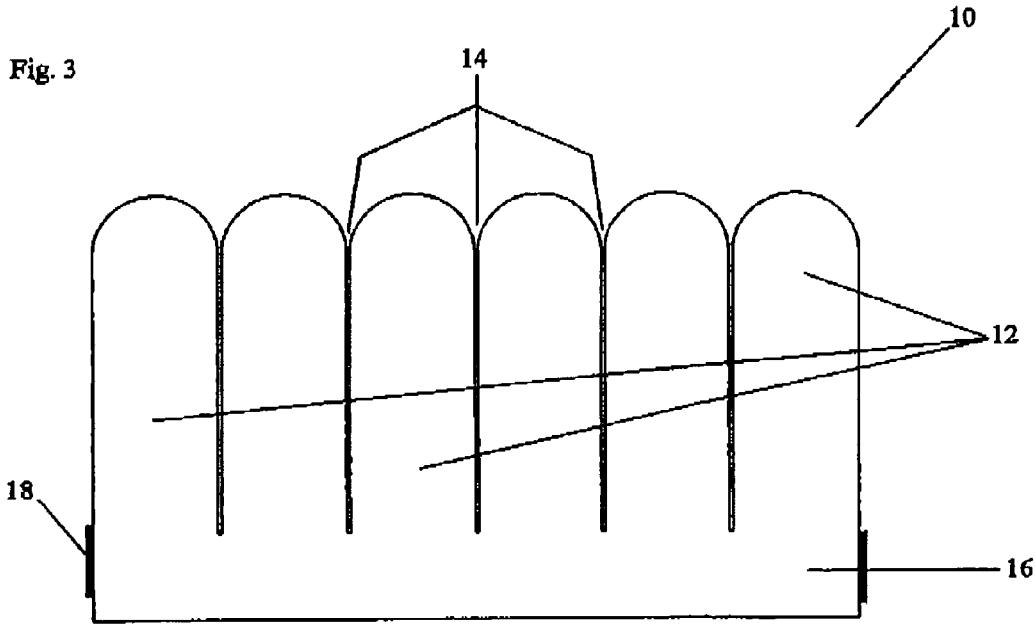
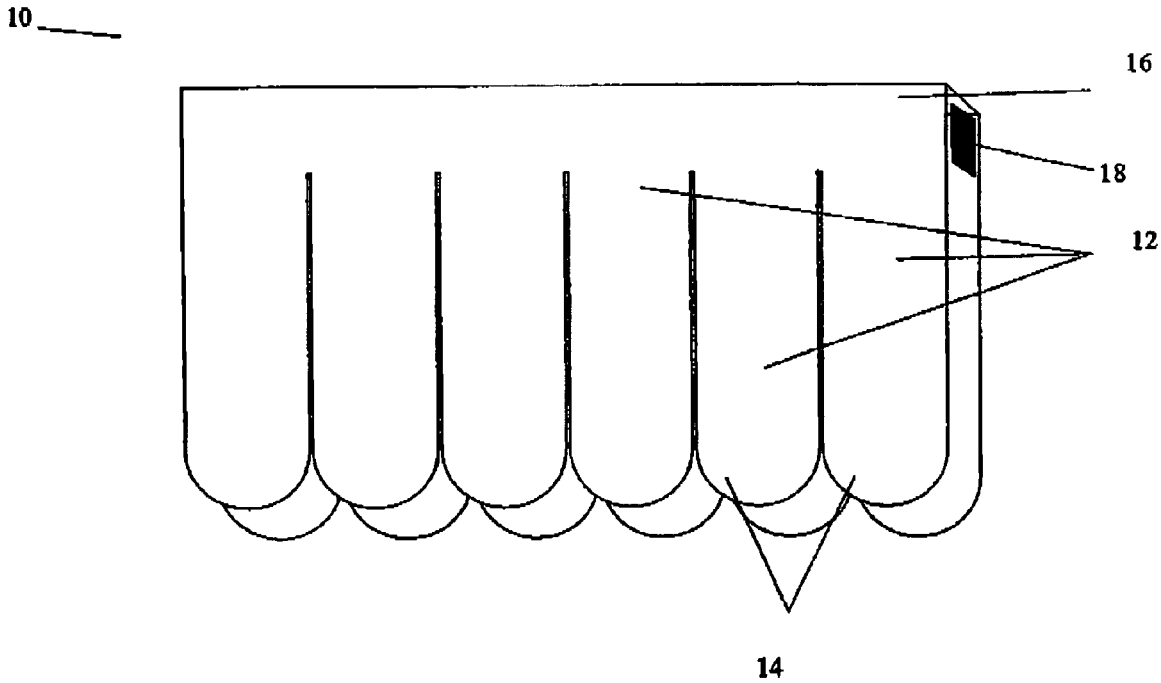
Fig. 4

DEVICE FOR MAINTAINING WINDOW COVERINGS OR VERTICALLY HANGING FLEXIBLE PANELS

CROSS REFERENCE TO RELATED APPLICATIONS

The present application claims priority from U.S. patent application Ser. No. 11/001,929 filed Dec. 2, 2004 now abandoned which claims benefit of U.S. Provisional Application Ser. No. 60/526,676, filed Dec. 3, 2003; Provisional Application Ser. No. 60/551,520, filed Mar. 9, 2004; and Provisional Application Ser. No. 60/559,888, filed Apr. 6, 2004.

BACKGROUND OF THE INVENTION

1. Field of the Invention

The invention relates to drapery hardware and more particularly to an easily installed or used system for maintaining draperies in a desired configuration.

2. Description of Related Art

Windows are commonly covered by one or more flexible panels in the form of curtains or drapes. These window coverings hang from a horizontal rod and extend downwards. In order to place the folds of the window covering in a desired orientation, the folds are placed manually. If there is air movement in the room due to air vents or a person walking through the room, the folds are disturbed. Currently, there is no method for retaining the desired folds in a window covering.

Specialized curtain and drape devices exist in the form of rods (U.S. Pat. No. 6,588,060), hooks and sashes (U.S. Pat. No. 6,408,927). Devices exist for creating drapes from vertical hanging Venetian blinds (U.S. Pat. No. 6,789,596). Specialized hanging systems as described in U.S. Pat. No. 6,789,600 allow for hanging drapes in a plurality of ornamental designs.

In another industry, several types of shower curtains and shower curtain accessories have been developed to prevent the shower curtain from moving while in use. For example, there are clips designed to hold the edges of the shower curtain to the tub. Weights or magnets may be embedded in the curtain material or they may be clipped on by the user. There are devices that act as a backbone for the shower curtain. These may take the form of an arm that is attached to the shower curtain rod or other structure of the shower to force the curtain to maintain its shape. Alternate shower curtains may be attached at both sides and slide up or down into place for use. U.S. Pat. No. 6,591,432 describes a shower curtain with lower pockets which capture water to weigh down the curtain to prevent movement during use.

An object of the present invention is to maintain draperies in a desired configuration.

An object of the present invention is to maintain draperies in a desired configuration regardless of air movement around the draperies.

An object of the present invention is to force draperies back into a desired configuration if they are physically moved.

An object of the present invention is to block air from blowing out the draperies.

Finally, it is an object of the present invention to accomplish the foregoing objectives in a simple and cost effective manner.

SUMMARY OF THE INVENTION

The present invention addresses these needs by providing a device for maintaining a desired orientation of a hanging flexible panel. The device includes a frame which can be formed into a desired shape and is capable of maintaining the flexible panel within the desired shape. The device further includes an attachment means for attaching the frame to the flexible panel such that the attachment means is perpendicular to the frame when attached to the flexible panel. The device includes a plurality of teeth and an opening in between each adjacent pair of teeth. The teeth are preferably formed in substantially parallel orientation. If desired, the outer surfaces of the teeth can include a frictional retention means such as protuberances or a roughened surface treatment. The frame may include a support backbone and is preferably made from a lightweight, nonporous material such as styrofoam, plastic, wire or wood. To attach the device to the flexible panel, it preferably includes at least one prong which is oriented perpendicularly to the frame. Each prong may be inserted into a pocket formed in the flexible panel. For ease of use or manufacture, the prongs may be movable between an orientation which is parallel to the frame and an orientation which is perpendicular to the frame. In this design, the prongs are moved to the perpendicular orientation and then inserted into the pocket formed in the flexible panel.

BRIEF DESCRIPTION OF THE DRAWINGS

A more complete description of the subject matter of the present invention and the advantages thereof, can be achieved by the reference to the following detailed description by which reference is made to the accompanying drawings in which:

FIG. 3 is a top view of an alternate embodiment of the present invention;

FIG. 4 is a side perspective view of the alternate embodiment of the present invention 10 shown in FIG. 3;

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. While the invention has been described as being for draperies or curtains, use with any vertically hanging flexible panel is contemplated.

The drapery system is constructed from a lightweight, somewhat flexible material such as foam, plastic or cardboard. Any material which is fairly lightweight and resistant to breaking yet flexible is satisfactory. The device generally is a single piece construction, designed for a standard drapery panel. Larger or smaller devices can be constructed for drapery panels of different sizes. The thickness of the device depends on the strength of the material used for construction. A material with high break resistance, such as plastic, can be made thinner, while a weaker material, such as foam, would be made thicker. The material is preferably nonporous to prevent airflow therethrough.

Figure 1:
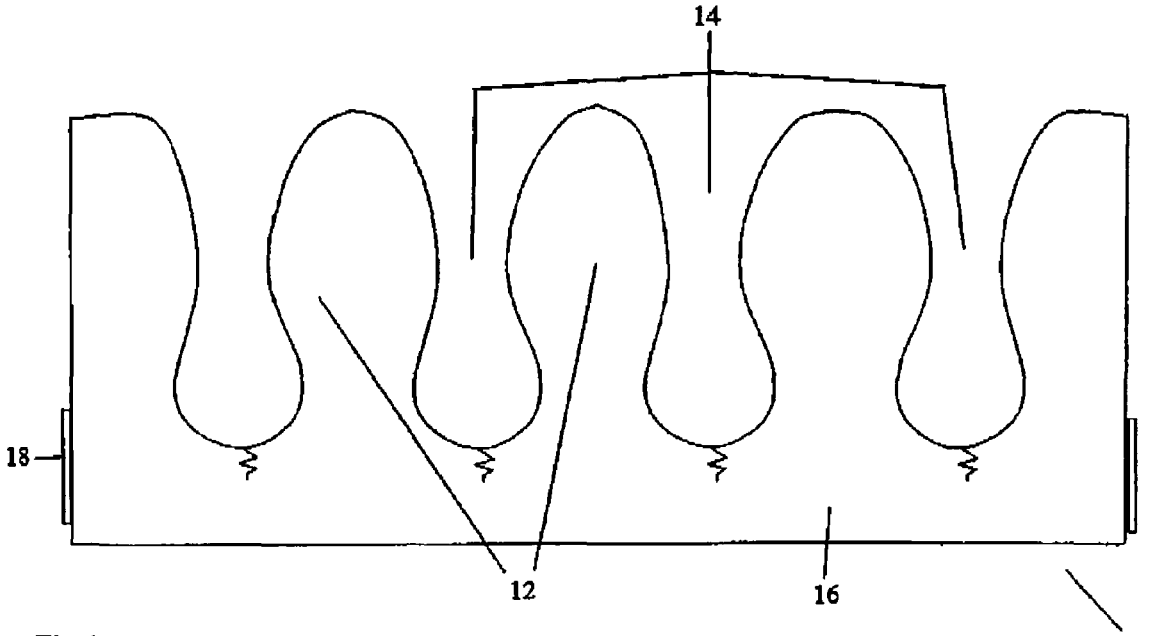
FIG. 1 is a top view of the preferred embodiment of the present invention.
Figure 2:
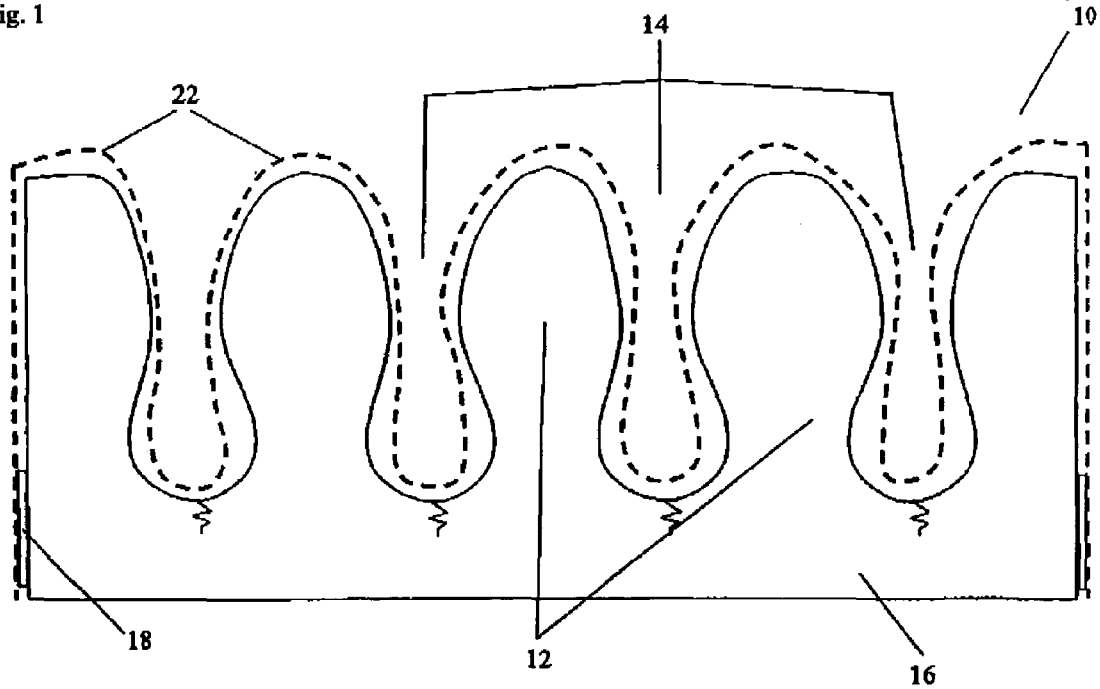
FIG. 2 is a top view, showing the preferred embodiment of the invention shown in FIG. 1 in use.
Figure 5:
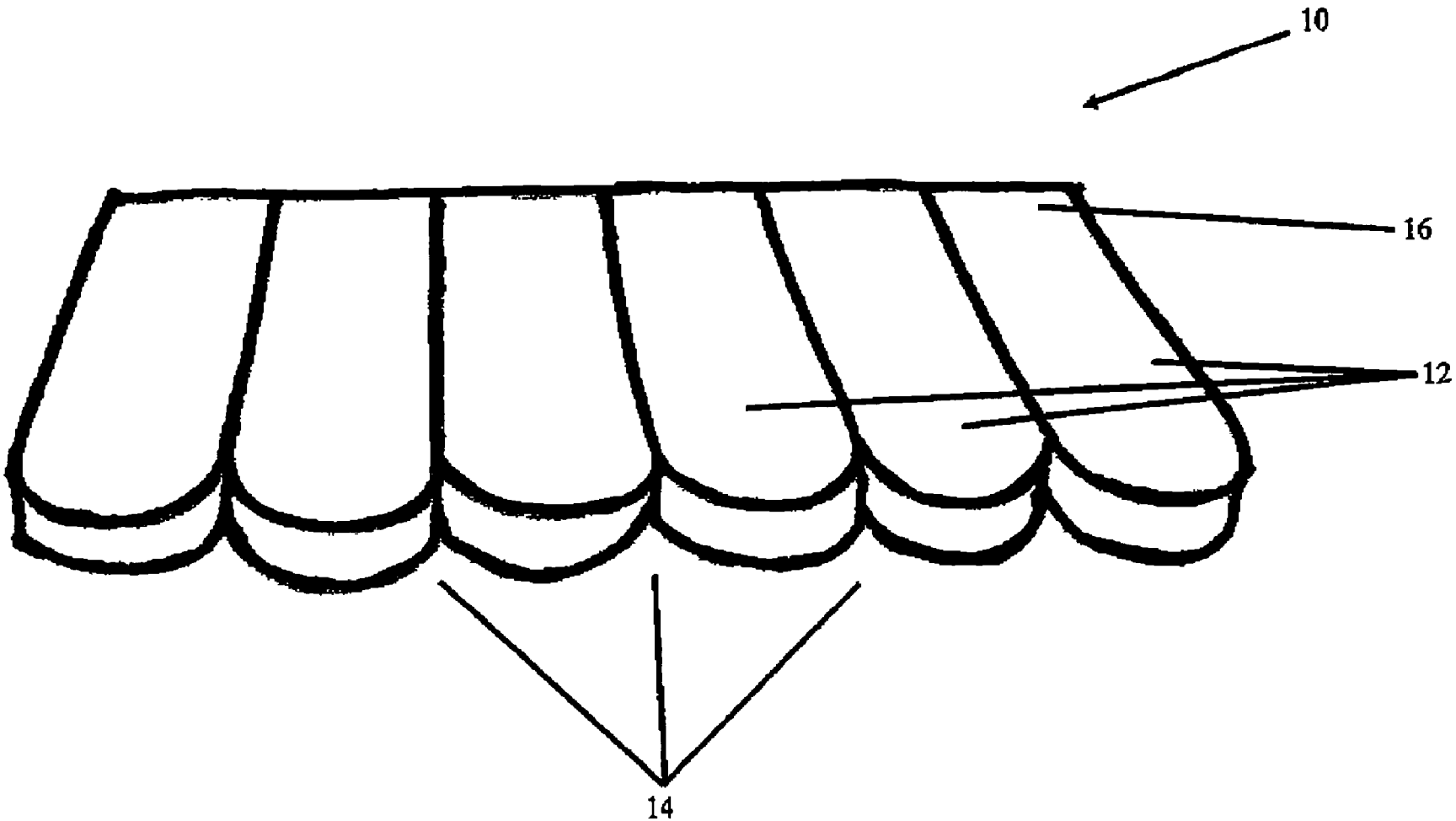
FIG. 5 is a front perspective view of the alternate embodiment of the invention shown in FIGS. 3 and 4.

In the preferred embodiment, shown in FIGS. 1 and 2, the device 10 is made from foam which is approximately ¾" thick. The device is approximately 12½" long and 6" at the widest dimension. The device 10 has five teeth 12 which are substantially parallel to each other. There are slits 14 in between the teeth 12 which do not extend along the entire length of the teeth 12. In the preferred embodiment, the slits 14 are cut into the foam material. Beyond the slits 14, the teeth 12 are held together by a lengthwise section or backbone 16. The teeth 12 are rounded at their distal ends. The slits 14 are designed to be narrower at the distal ends and wider at the proximal ends near the backbone 16. On the outside edge of the outside teeth 12, an attachment means 18 may be used for attaching the ends of the drapery to the device 10. The attachment device is preferably hook and loop fastener but may be any suitable attachment such as one or more snaps, buttons, hooks or other similar attachment apparatus.

As shown in FIG. 2, to use the preferred embodiment of the invention 10 shown in FIG. 1, it is placed behind a drapery panel 22 with the backbone 16 facing the wall or surface behind the drapery 22 and the teeth 12 and slits 14 facing the drapery 22. While the device 10 is being held in a substantially level orientation with respect to the ground, drapery 22 material is fed into the slits 14, preferably such that a similar amount of material is fed into each slit 14. Thus, the drapery 22 material is preferably distributed evenly along the device 10 and in the slits 14. It is not necessary for drapery 22 material to fit snugly around the distal ends of the teeth 12. Once all slits 14 contain drapery 22 material, the ends of the drapery 22 are attached to the outside edge of the device by using hook and loop fastener 18 and the backbone 16 is allowed to rest against the surface behind the drapery 22. The device 10 then holds the drapery 22 in the preferred orientation regardless of air movement. If the drapery 22 is physically moved, the device 10 forces the drapery 22 back into the desired configuration once the physical force is removed. If necessary or desired, multiple devices 10 can be used along the length of a drapery panel 22. This provides additional stability for long draperies or for draperies subject to significant movement.

In one alternate embodiment shown in FIGS. 3-6, the device 10 is made from foam which is approximately ¾" thick. The device is approximately 12½" long and 6" at the widest dimension. The device 10 has six teeth 12 which are approximately 2" wide and which are substantially parallel to each other. There are slits 14 in between the teeth 12 which do not extend along the entire length of the teeth 12. In the preferred embodiment, the slits 14 are cut into the foam material. Beyond the slits 14, the teeth 12 are held together by a lengthwise section or backbone 16. The teeth 12 are rounded at their distal ends. On the outside edge of the outside teeth 12, an attachment means 18 may be used for attaching the ends of the drapery to the device. The attachment device is preferably hook and loop fastener 18 but may be any suitable attachment such as one or more snaps, buttons, hooks or other similar attachment apparatus.

Figure 6:
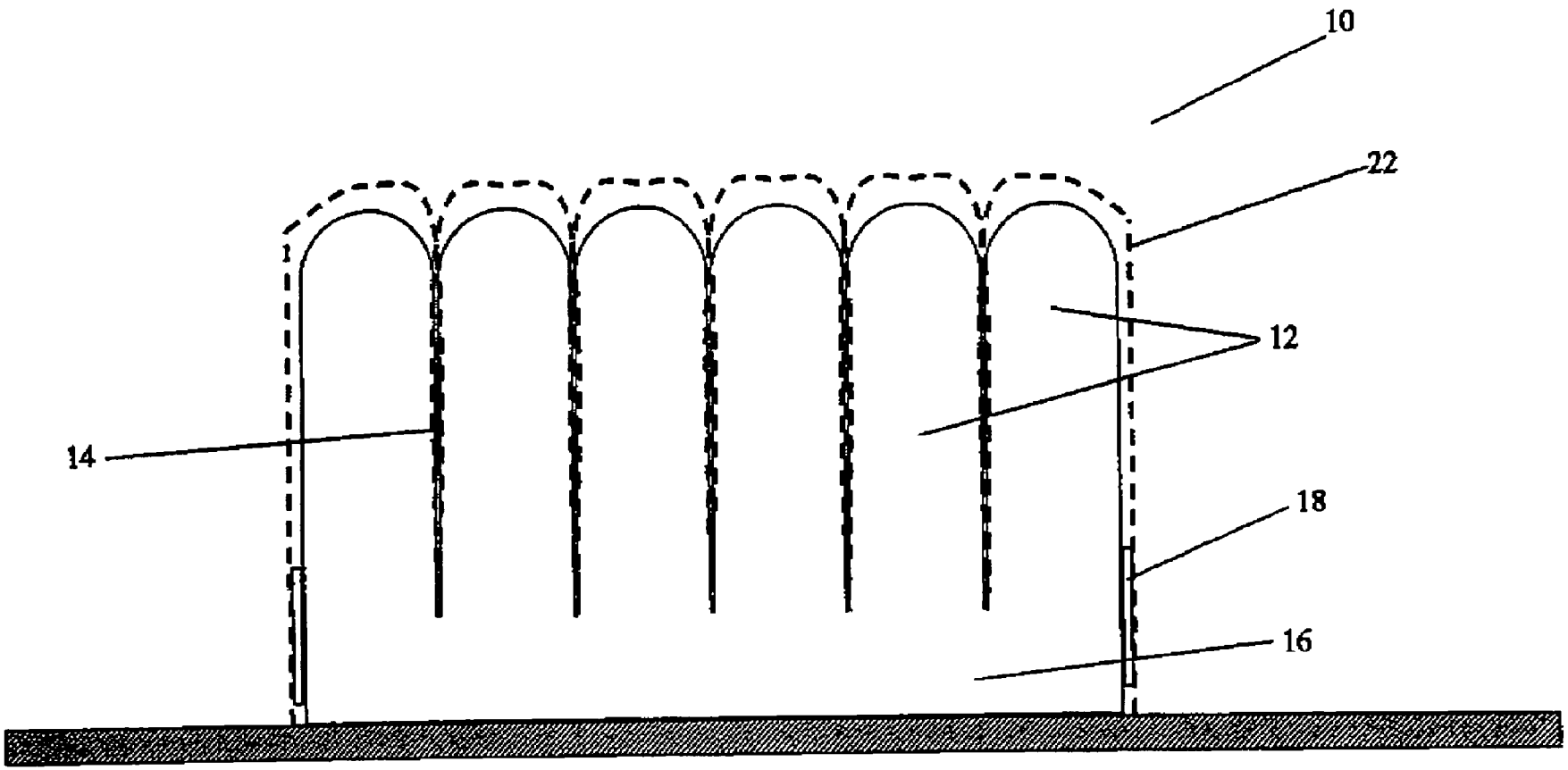
FIG. 6 is a top view, showing the alternate embodiment of the invention shown in FIGS. 3, 4 and 5 in use.

Use of this embodiment is shown in FIG. 6 and is similar to the use shown in FIG. 2. The invention 10 is placed behind a drapery panel 22 with the backbone 16 facing the wall or surface behind the drapery 22 and the teeth 12 and slits 14 facing the drapery 22. While the device 10 is being held in a substantially level orientation with respect to the ground, drapery 22 material is fed into the slits 14, preferably such that a similar amount of material is fed into each slit 14. Thus, the drapery 22 material is preferably distributed evenly along the device 10 and in the slits 14. It is not necessary for drapery 22 material to fit snugly around the distal ends of the teeth 12. Once all slits 14 contain drapery 22 material, the ends of the drapery 22 are attached to the outside edge of the device by using hook and loop fastener 18 and the backbone 16 is allowed to rest against the surface behind the drapery 22. The device 10 then holds the drapery 22 in the preferred orientation regardless of air movement. If the drapery 22 is physically moved, the device 10 forces the drapery 22 back into the desired configuration once the physical force is removed. Again, if necessary or desired, multiple devices 10 can be used along the length of a drapery panel 22. This provides additional stability for long draperies or for draperies subject to significant movement.

Figure 7:
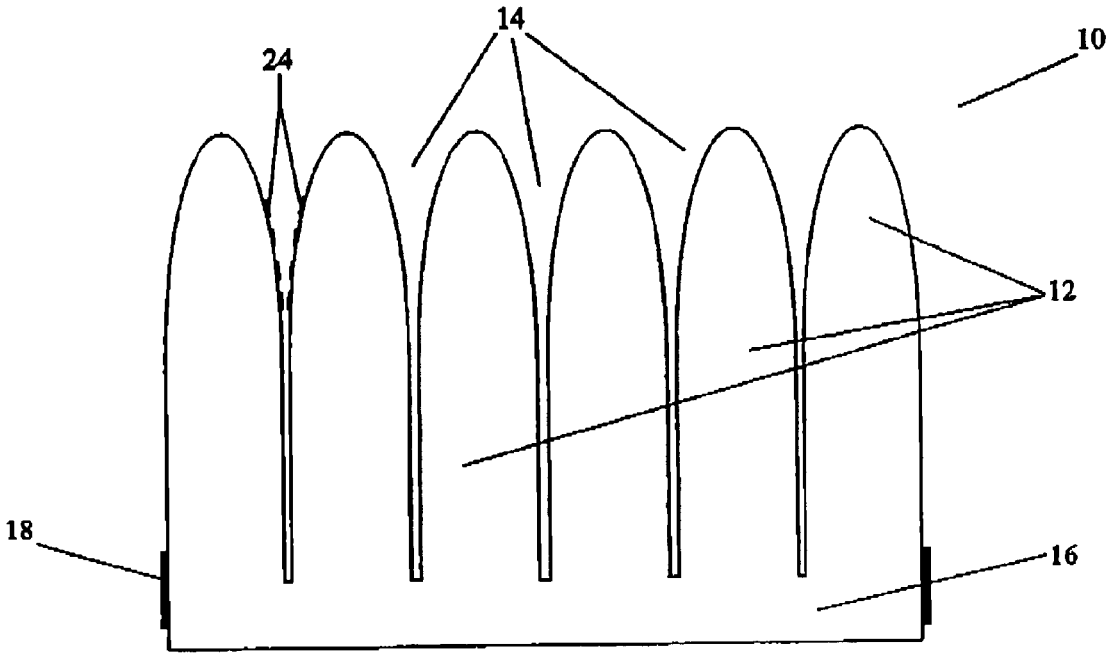
FIGS. 7 and 8 are top views of alternate embodiments of the present invention 10.
Figure 8:
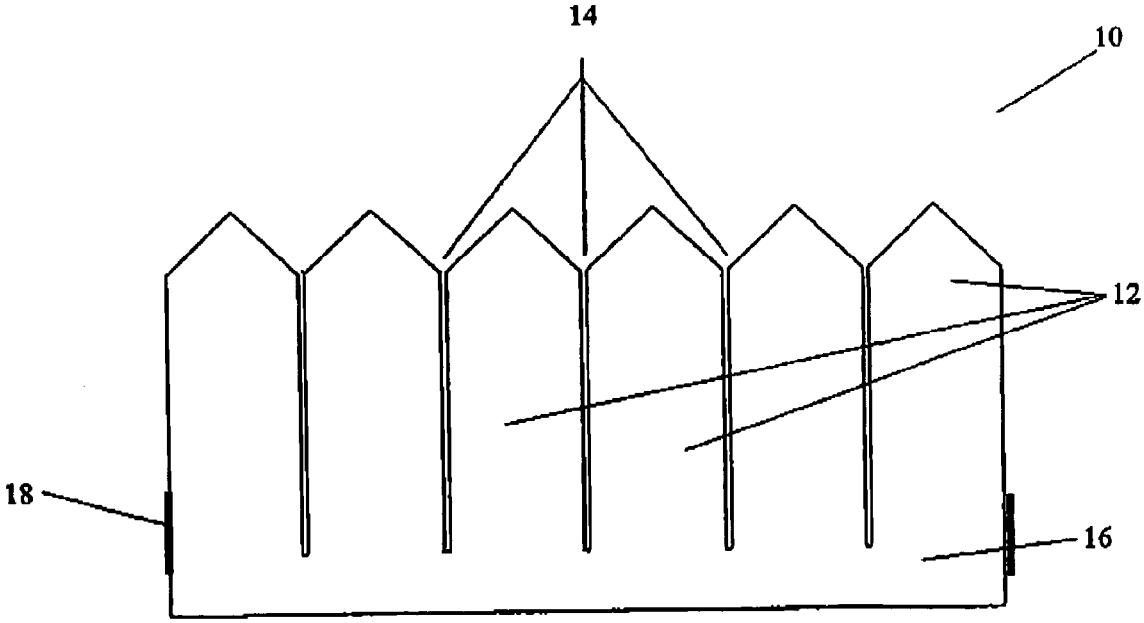

In other alternate embodiments, the distal ends of the teeth 12 may be different shapes as shown in FIGS. 7 and 8. The teeth 12 edges adjacent to the slits 14 may be roughened to provide additional friction against draperies. Or, instead of using a roughened surface, small protuberances 24 can be used to provide additional friction.

In another alternate embodiment, the slits 14 are formed through a molding process. In a further alternate embodiment, the backbone 16 is reinforced. This reinforcement can be accomplished by including a reinforcing outer covering around the backbone 16. Alternatively, the reinforcement can be accomplished by forming the backbone section 16 to have a greater thickness than the teeth 12.

Figure 9:
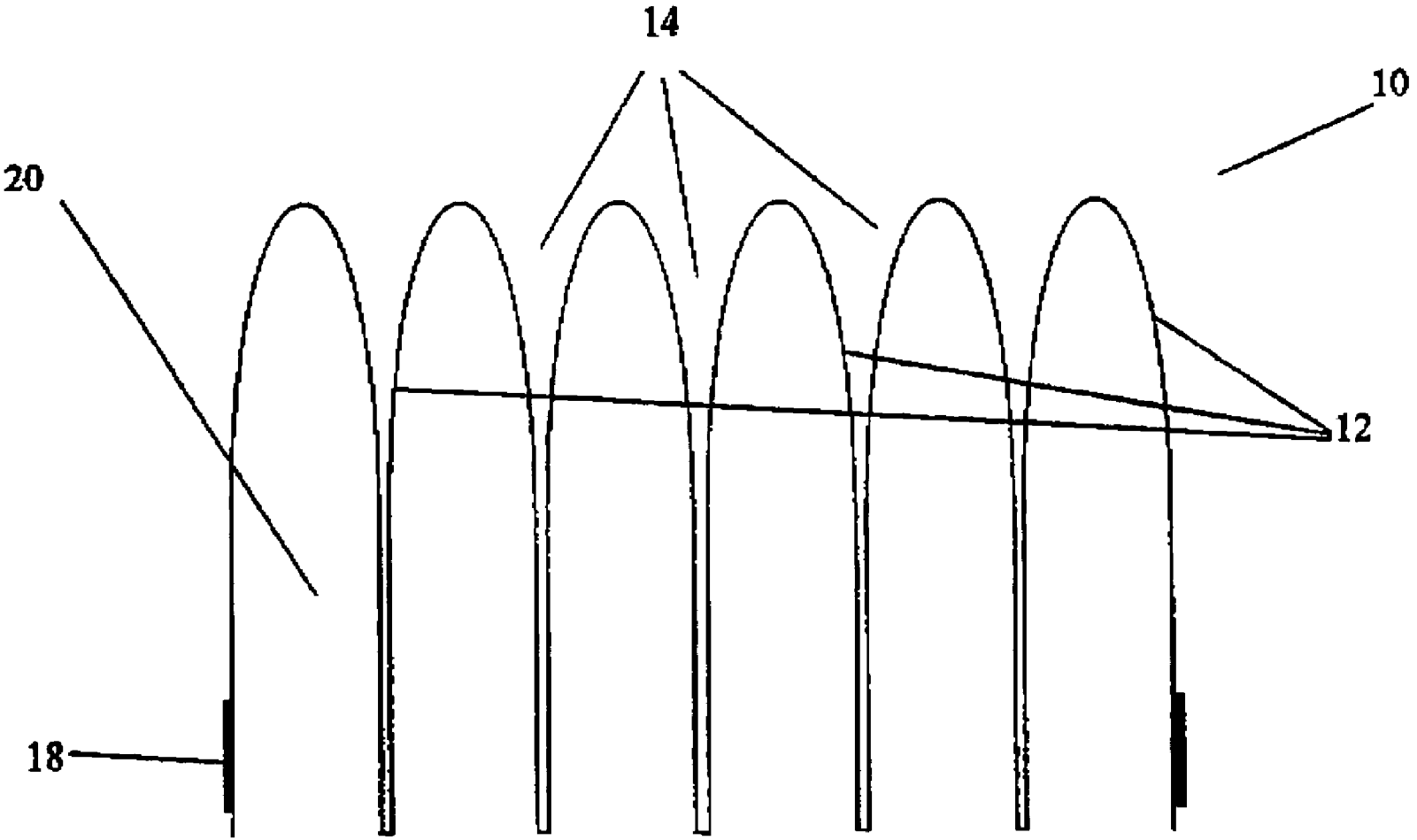
FIG. 9 is a top view of another alternate embodiment of the present invention.

In a further alternate embodiment, the device 10 is made as shown in FIG. 9. The teeth 12 are preferably formed from wire or plastic. In this embodiment, no backbone is needed. The slits 14 are as described previously. The inner edges of the teeth 12 which contact the drapery 22 can include roughened surfaces or protuberances if desired, for additional friction against the drapery 22. The area 20 within the teeth can be open or can be covered by a nonporous material. A nonporous material would be used in instances where it is desirous to reduce airflow behind the drapery 22. As described previously, hook and loop fastener 18, or other appropriate attachment means, is preferably used to attach the ends of the drapery 22 to the device 10, although other fastening means may also be used. The tooth shapes shown in FIGS. 1 and 3-5 can all be constructed in this manner, as can other shapes.

Figure 10:
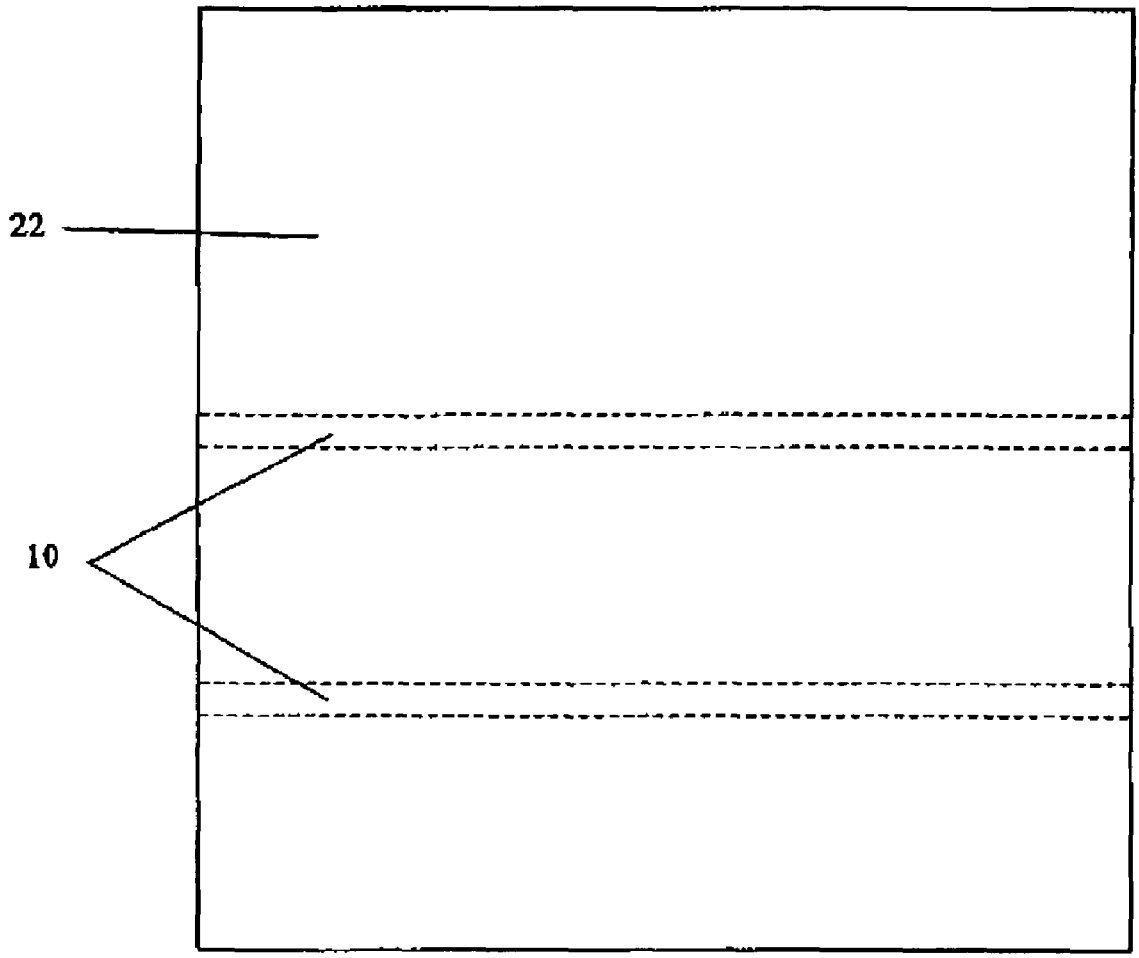
FIG. 10 is a front view of another alternate embodiment of the present invention in place.

Another alternate embodiment is shown in FIG. 10. In this embodiment, a deformable metal strip is placed in between the lining of the drape and the drapery 22. This embodiment generally shaped similarly to the embodiment shown in FIG. 9. The shaping of the device 10 can occur prior to or after it is placed between the lining and the drapery 22. To provide the necessary weight and allow deformation of the metal strip, it is preferably made from a 1 inch tall lead strip which is 3/16 inch thick. This embodiment can be used to form the shapes shown in FIGS. 1, 2, 7 and 8 as well as many other appropriate shapes.

Figure 11:
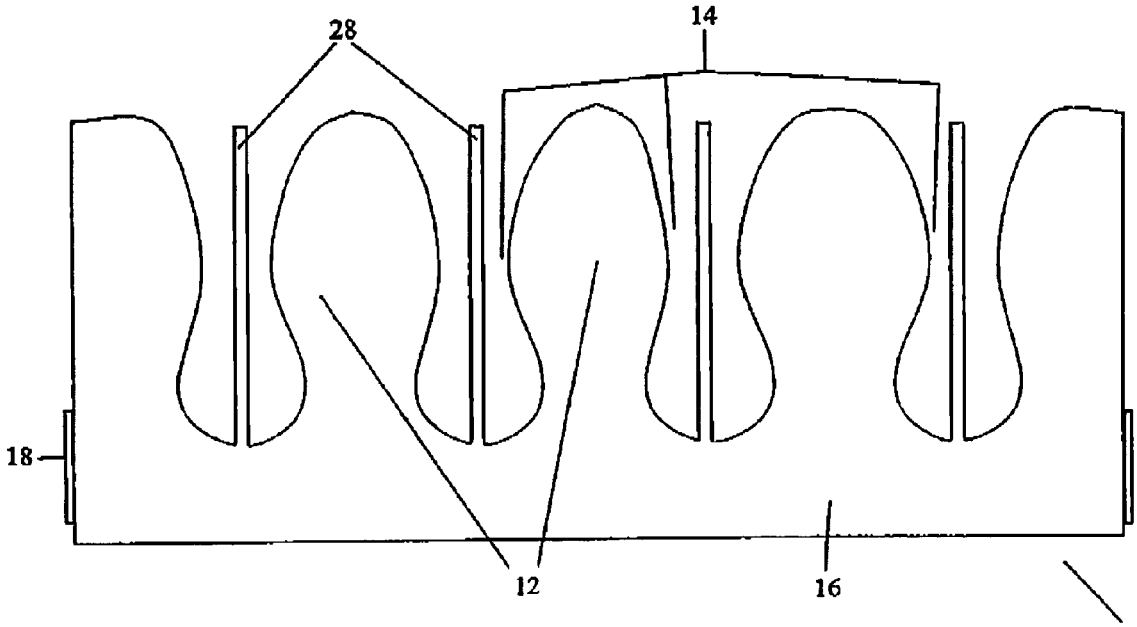
FIG. 11 is a top view of an alternate embodiment of the present invention.
Figure 12:
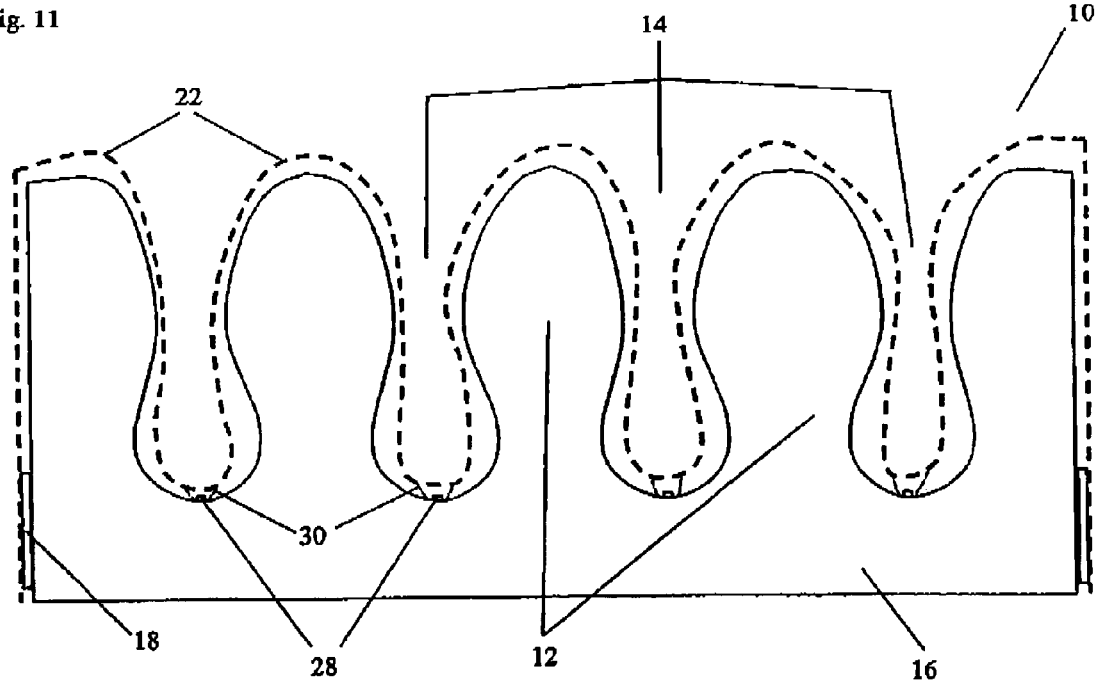
FIG. 12 is a top view, showing the alternate embodiment of the invention shown in FIG. 11 in use.
Figure 13:
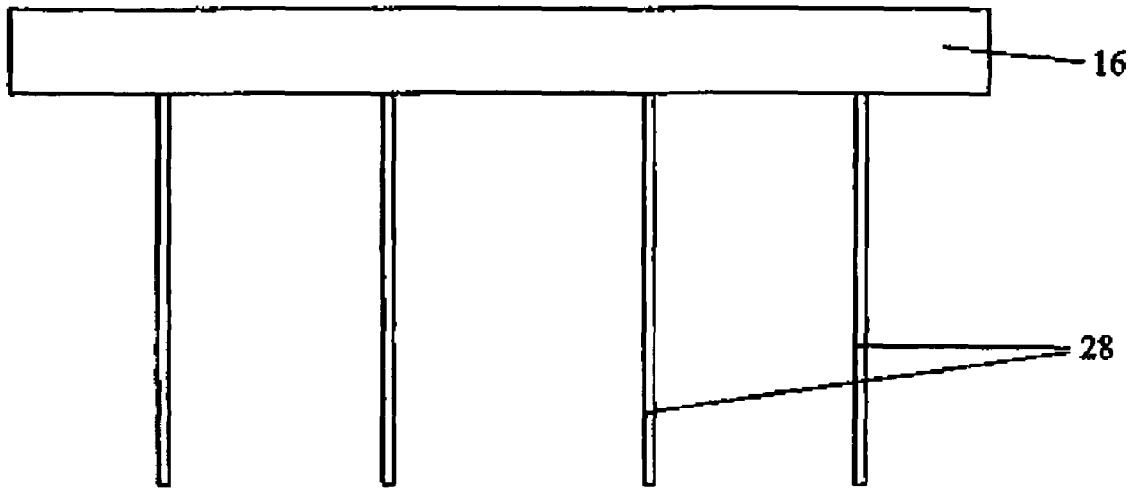
FIG. 13 is a side view of the alternate embodiment of the present invention shown in FIGS. 11 and 12.

Another alternate embodiment is shown in FIGS. 11-13. In this embodiment, the slits 14 are cut into the foam material. Beyond the slits 14, the teeth 12 are held together by a lengthwise section or backbone 16. The teeth 12 are rounded at their distal ends. The slits 14 are designed to be narrower at the distal ends and wider at the proximal ends near the backbone 16. On the outside edge of the outside teeth 12, an attachment means 18 may be used for attaching the ends of the drapery to the device 10. The attachment device is preferably hook and loop fastener but may be any suitable attachment such as one or more snaps, buttons, hooks or other similar attachment apparatus. Prongs 28 are constructed in between the teeth 12. For ease of use, the prongs 28 may be manufactured parallel to the teeth 12. To attach the device 10 to the drapery panel 22, the drapery panel includes pockets 30. The prongs 28 are bent into an orientation perpendicular to the frame of the device 10 and inserted into the pockets 30. This step pulls the drapery panel 22 in between the teeth 12 and retains the desired curved shape of the drapery panel 22.

Many improvements, modifications, and additions will be apparent to the skilled artisan without departing from the spirit and scope of the present invention as described herein and defined in the following claims.

What is claimed is:

1. A device for maintaining a desired orientation of a hanging flexible panel having a pocket, comprising:

a frame formed into a desired shape capable of maintaining the flexible panel within the desired shape;

the frame having a plurality of parallel teeth;

an attachment means for attaching the frame to the flexible panel;

wherein the attachment means is at least one prong between the teeth and which is oriented perpendicularly to the teeth; and wherein the frame is attached to the flexible panel by inserting a portion of the flexible panel between the teeth and inserting the at least one prong into the pocket of the flexible panel.

2. The device as set forth in claim 1 wherein the frame further comprises and an opening in between each adjacent pair of teeth.

3. The device as set forth in claim 2 wherein the plurality of teeth are formed in substantially parallel orientation.

4. The device as set forth in claim 2 wherein the plurality of teeth include a frictional retention means.

5. The device as set forth in claim 4 wherein the frictional retention means is selected from the group consisting of protuberances and a roughened surface treatment.

6. The device as set forth in claim 1 wherein the frame further comprises a support backbone.

7. The device as set forth in claim 1 wherein the frame comprises a lightweight, nonporous material.

8. The device as set forth in claim 1 wherein the frame comprises a lightweight, nonporous material selected from the group consisting of styrofoam, plastic, wire and wood.

9. The device as set forth in claim 1 wherein the at least one prong is movable between an orientation which is parallel to the frame and an orientation which is perpendicular to the frame.

10. The device of claim 6, wherein the plurality of teeth extend from the backbone in substantially parallel orientation and include two outside teeth, each of the two outside teeth defining an outside edge surface and the device further comprises an attachment device on the outside edge of each of the outside teeth.

* * * * *